United States Patent [19]

Cockman

[11] Patent Number: 4,625,915

[45] Date of Patent: Dec. 2, 1986

[54] SPRINKLER HEAD APPARATUS

[76] Inventor: Haggie I. Cockman, Post Office Box 1600, Sanford, Fla. 32771

[21] Appl. No.: 725,363

[22] Filed: Apr. 19, 1985

[51] Int. Cl.[4] ..... B05B 1/26

[52] U.S. Cl. ..... 239/390; 239/505; 239/524; 239/DIG. 1

[58] Field of Search ..... 239/505, 518, 524, 390, 239/DIG. 1

[56] References Cited

U.S. PATENT DOCUMENTS

| | | | |
|---|---|---|---|
| 1,272,274 | 7/1918 | Kinealy | 239/524 |
| 1,401,176 | 12/1921 | Miller et al. | 239/505 |
| 1,597,715 | 8/1926 | Blackburn | 239/518 |
| 1,876,669 | 9/1932 | Harlow | 239/524 |
| 2,562,503 | 7/1951 | Meffan | 239/390 |
| 2,711,925 | 6/1955 | King | 239/DIG. 1 |
| 3,788,552 | 1/1974 | Roberts | 239/DIG. 1 |
| 4,194,693 | 3/1980 | Mikulesky | 239/390 |
| 4,310,122 | 1/1982 | Vikre | 239/DIG. 1 |

FOREIGN PATENT DOCUMENTS

| | | | |
|---|---|---|---|
| 1196597 | 11/1959 | France | 239/524 |
| 1492784 | 6/1965 | France | 239/524 |

*Primary Examiner*—Joseph F. Peters, Jr.
*Assistant Examiner*—Michael J. Forman
*Attorney, Agent, or Firm*—William M. Hobby, III

[57] ABSTRACT

A sprinkler head apparatus has a sprinkler head body portion having a threaded base for attaching to a water line and a nozzle for directing water from the water line through the sprinkler head body portion. A plurality of fixed deflector elements are removably attached by a simple press fit to the sprinkler head body. Each deflector member is shaped to produce a predetermined deflected water pattern from the water exiting the nozzle. Each of the fixed deflector members has a deflector portion and an attaching portion for attaching the deflector members into the opening in the sprinkler head body. The fixed deflector members attaching portion includes a wedging portion thereon for locking the deflector member to the sprinkler head body with the force of water from the nozzle impinging against the deflector portion. This wedging action not only holds the deflector member into the sprinkler head body but holds it against loosening from the action of the water from the nozzle.

6 Claims, 7 Drawing Figures

SPRINKLER HEAD APPARATUS

BACKGROUND OF THE INVENTION

The present invention relates to a sprinkler head, and especially to a sprinkler head with replaceable deflector surfaces for deflecting water in different patterns.

In the past, a wide variety of sprinkler heads have been provided and a number have been placed in production. Common sprinkler heads on the market vary in both quality and price over a substantial range, but in sprinkler heads that provide for a variety of patterns, the costs generally have been greater. The present invention is directed towards a sprinkler head providing for a variety of spray patterns which can be marketed in the low price range of sprinkler heads. Typical prior sprinkler heads can be seen in the following U.S. patents.

| U.S. Pat. No.: | INVENTOR |
|---|---|
| 1,801,459 | C. H. SLAUTER |
| 696,057 | C. E. LANSTRUM |
| 3,586,244 | T. JOHNSON |
| 1,401,176 | A. C. MILLER, ET AL. |
| 3,785,572 | O. M. ARNOLD, ET AL. |
| 3,014,668 | E. L. BOYD |
| 3,189,283 | J. R. MOORE |
| 1,272,274 | J. H. KINEALY |
| 1,764,570 | J. C. LOHMAN |
| 2,562,503 | R. W. MEFFAN |
| 1,639,162 | J. A. BROOKS |
| 3,877,644 | H. I. COCKMAN |

The prior Cockman patent shows a sprinkler head and game apparatus combination, while the listed Brooks patent has a spring devise with different forms of spray direction members shown in different figures. The Meffan patent shows a lawn sprinkler having more than one spray pattern for water to impinge thereupon. The Lohman patent shows a sprinkler head with changeable spray heads, while the Kinealy patent has a removable spray plate. The listed Moore patent shows a sprinkler head in which the water is impinged upon a flat surface and one embodiment but has modified deflector surfaces in two of the other shown embodiments. The Boyd patent shows a sprinkler for spraying a generally square pattern from the edge of a building, or the like. The Arnold, et al., patent has a plastic line spray nozzle which is removably attached and shows several different embodiments for deflector surfaces to obtain different patterns in the spray. The Miller patent shows a spray head in which liquid is impinged upon a spray surface, as does the Johnson patent and the Lanstrum patent and the Slauter patent. The present sprinkler head has a plurality of replaceable deflection surfaces which are fixed deflectors which can be press fitted into the sprinkler head body for generating a predetermined spray pattern. The deflector surfaces are locked in for position against the movement and changing of the spray pattern by the force of the water from the nozzle impinging thereupon driving a wedging portion into the opening and thus supplying a continuous force whenever the sprinkler is being utilized.

SUMMARY OF THE INVENTION

The sprinkler head apparatus has a sprinkler head body having a threaded attachment portion for attaching the sprinkler head body to a water source and has a nozzle for directing water from the sprinkler head body. The sprinkler head body has an arm supporting a deflecting surface from the base of the sprinkler, has changable heads for spraying different shaped areas. A plurality of fixed deflector members are removably attachable to an opening in the sprinkler head body by simply inserting a portion of the deflector member in an opening of the sprinkler head body arm. The fixed deflector member is positioned to deflect water from the nozzle in a predetermined pattern, and each fixed deflector member has a deflector portion and an attaching portion for attaching the fixed deflector members to the opening in the sprinkler head body. The attaching portion of the fixed deflector member includes a wedging portion thereon for locking the deflector member to the body with the force of the water from the nozzle impinging against the deflector portion so that a deflector member can be held against loosening by the water from the nozzle.

BRIEF DESCRIPTION OF THE DRAWINGS

Other objects, features and advantages of the present invention, will be apparent from the written description and the drawings in which.

DESCRIPTION OF THE PREFERRED EMBODIMENT

Figure 1:
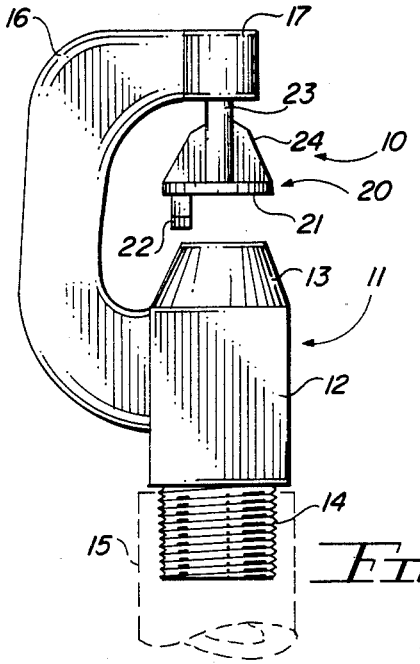
FIG. 1 is a sectional view of a sprinkler head in accordance with the present invention.
Figure 3:
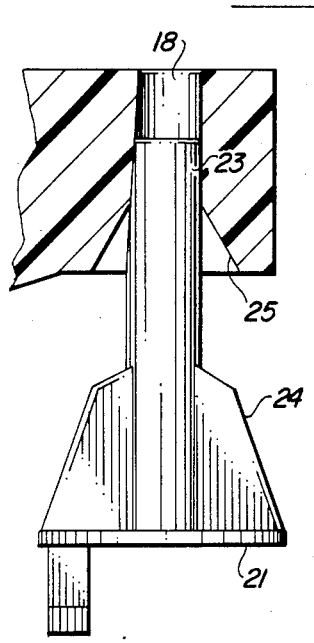
FIG. 3 is a sectional view of a portion of the sprinkler head.
Figure 3:
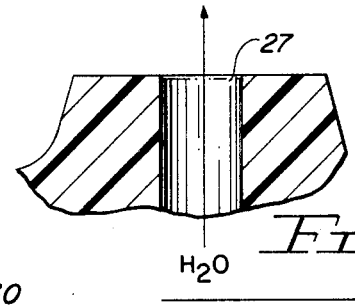

Referring to the drawings, a sprinkler head 10 is illustrated having a sprinkler head body 11 which includes a base portion 12, a nozzle portion 13 and a threaded attachment 14 for attaching the body 11 to a water line 15. The sprinkler head body 11, base portion 12 has a U-shaped side arm 16 extending therefrom with a deflector support portion 17 on the end of the arm 16. Deflector support portion 17 has a bore 18 extending therethrough for holding a deflector member 20. Deflector member 20 has a deflection surface 21 facing the nozzle 13 so that water passing through the water line 15 through the sprinkler head body 11, base portion 12 and through the nozzle 13 is impinged directly upon the surface 21 while the deflector member 20 is attached to the deflector support portion 17 and deflects the water in a pattern depending upon the shape of the deflector member 20. A deflection extension 22 attached to the deflector surface 21 helps direct the pattern of water as desired as shown in FIG. 1. The deflector member 20 has the deflector surface 21 and an attaching portion or shaft 23 along with a wedge locking portion 24. The bore 18 has a countersunk portion 25 for the wedge shaped portion 24 of the deflector member 20 to wedge thereinto to hold the wedge shape portion in place. In addition the bore 18 is tapered towards the end to provide a pressed fitting as the shaft support portion 23 is pushed therein. Thus, neither threads or other fastening members are required and which might be time consuming. The press fit is not shifted by the action of the water passing through the nozzle 27 against the deflection surface 21 because of the wedging action which is increased as the water pushes against the surface 21 wedging the wedging portion 24 and the press fitted portion more tightly into the bore 18 and countersunk portion 25.

Figure 4:
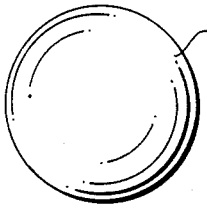
FIG. 4 is an end elevation of one embodiment of a deflector member.
Figure 5:
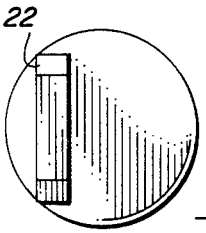
FIG. 5 is an end elevation of a second deflector member.
Figure 2:
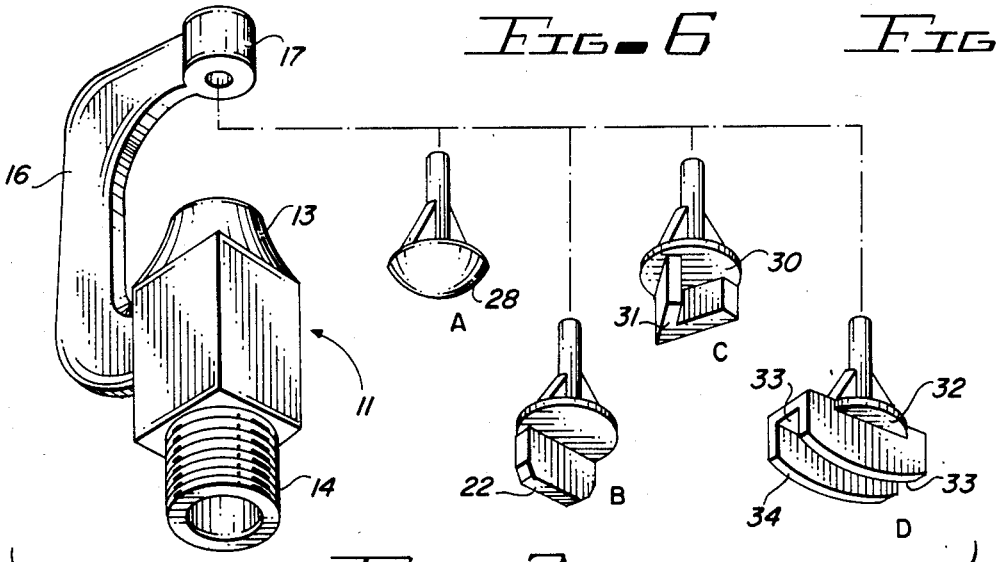
FIG. 2 is an exploded perspective of the sprinkler head of FIG. 1 showing a variety of deflector surfaces.

In FIG. 4, a semi-spherical deflection surface 28 fits onto the deflecting member 24 to direct the water impinging upon it in all directions for a uniform distribution, while the deflection surface 20 has a flat surface, as shown also in FIGS. 1 and 2 with the shaped portion 22 protruding therefrom to prevent backsplash of the water impinging thereupon.

Figure 6:
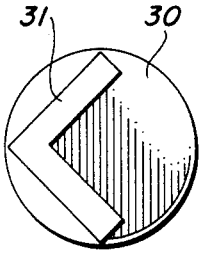
FIG. 6 is an end elevation of a third deflector member.

FIG. 6 shows a deflecting surface 30 which is circular and flat and has a triangular protruding portion 31 to prevent water from being deflected in the direction of the two arms of the triangular portion 31 for a more limited and directional spray pattern.

Figure 7:
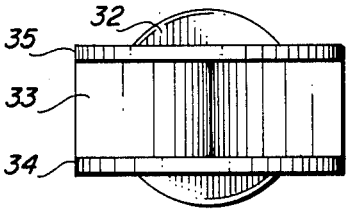
FIG. 7 is an end elevation of a fourth deflector member.

FIG. 7 has a flat deflected surface 32 but impinges the water upon a rectangular deflecting portion 33 having a pair of sides 34 and 35 to direct the deflecting water in a pair of paths on opposite sides of the sprinkler. The deflecting members in FIGS. 4, 5, 6, and 7 are also shown in FIG. 2, each having the triangular wedging portion 24 attached to the back of the deflecting surface adjacent the support shaft 23.

It should be clear at this point that a sprinkler head has been provided which can be inexpensively injection molded while simultaneously injection molding a series of deflecting surfaces which can be snapped into place by a quick press fit of a shaft and wedged by the force of water egressing from the nozzle impinging thereupon. The water continues to push the wedging portion into the bore to prevent the deflection surface from rotating and changing the pattern or from coming out. It should also be clear, however, that the present invention is not be considered as limited to the forms shown which are to be considered illustrative rather than restrictive.

I claim:

1. A sprinkler head comprising:

a sprinkler head body portion having attaching means for attaching the sprinkler head body portion to a water source and nozzle means for directing water from said sprinkler head body portion;

an arm attached to said sprinkler head body and extending over said nozzle means, said sprinkler arm having an opening having a tapered bore therethrough in general alignment with said nozzle;

a plurality of fixed deflection members, each deflection member being removably attachable to said opening in said arm and positioned to deflect water from said nozzle in predetermined patterns, and each said fixed deflection member having a deflection portion and an attaching portion for attaching the fixed deflection member into the opening in said arm, said deflection member being positioned between the nozzle means and the opening in the arm; and said attaching portion including a wedging portion thereon for locking one said deflection member to said arm and each said fixed deflection member attaching portion having a pair of angled wedging portions thereon for wedging said deflection member in said arm opening with the force of the water from the nozzle impinging thereagainst whereby deflecting members are held against loosening in said arm by the water from a sprinkler head nozzle.

2. A sprinkler head in accordance with claim 1 in which one of said plurality of fixed deflection members includes one having a rounded deflection portion thereon for deflecting water in a substantially circular pattern.

3. A sprinkler head in accordance with claim 1 in which one of said plurality of fixed deflection members deflection portion includes a flat surface having a protruding lip along the edge thereof for blocking the deflection of water impinged upon the flat surface past the lip.

4. A sprinkler head in accordance with claim 3 in which said arm is a generally U-shaped arm extending from said sprinkler head body to a position above said nozzle means to align said bore directly over the nozzle means output.

5. A sprinkler head in accordance with claim 1 in which one fixed deflection member deflection portion includes a flat surface having a lip thereon forming a "V" pattern on said flat surface.

6. A sprinkler head in accordance with claim 1 in which one deflection member deflection portion includes a channel shaped member having a "U" cross-section having an open side and a pair of open ends with the open side facing the sprinkler head body portion nozzle means so that water from said nozzle means is directed out each open end of the channel.

* * * * *